US005335595A

United States Patent [19]

Yamashita et al.

[11] Patent Number: 5,335,595

[45] Date of Patent: Aug. 9, 1994

[54] ROLLER OFFSET PRINTING APPARATUS

[75] Inventors: Kenkichi Yamashita; Hideaki Oyanagi, both of Kanagawa, Japan

[73] Assignee: NSK Ltd., Tokyo, Japan

[21] Appl. No.: 84,608

[22] Filed: Jul. 1, 1993

[30] Foreign Application Priority Data

Jul. 1, 1992 [JP] Japan ..... 4-197794

[51] Int. Cl.[5] ..... B41F 3/36; B41F 3/66

[52] U.S. Cl. ..... 101/158; 101/251; 101/286

[58] Field of Search ..... 101/158, 159–162, 101/150, 186, 250, 251, 282, 283, 284, 285, 286, 35, 486, 212

[56] References Cited

U.S. PATENT DOCUMENTS 4,841,857 6/1989 Hashimura et al. ..... 101/158

FOREIGN PATENT DOCUMENTS 3-61539 3/1991 Japan ..... 101/158

376676 12/1991 Japan .

*Primary Examiner*—J. Reed Fisher

*Attorney, Agent, or Firm*—Sughrue, Mion, Zinn, Macpeak & Seas

[57] ABSTRACT

A roller offset printing apparatus comprising: a linear stage movable forwards and backwards; a stage driving means for driving said linear stage; a master plate and a work plate disposed at a predetermined interval on said linear stage, said master plate having ink pits reserving ink; a roller transfer drum supported rotatably; a roller transfer drum driving means for driving said roller transfer drum so that said roller transfer drum rotates on the surface of said master plate to transfer the ink in said ink pits of said master plate onto the outer circumferential surface of said roller transfer drum and said roller transfer drum further rotates on a surface of said work plate to thereby transfer the ink from the outer circumferential surface of said roller transfer drum onto the surface of said work plate; a rotation force transmission control means for controlling on/off of transmission of rotation force from said roller transfer drum driving means to said roller transfer drum; a rotation angle detection means for detecting the rotation angle of said roller transfer drum; and a transfer control means for turning off said rotation force transmission control means at the time of start of transfer to thereby cut off transmission of the rotation force from said roller transfer drum driving means to said roller transfer drum and for turning on said rotation force transmission control means at the time of completion of transfer to thereby return said roller transfer drum to a transfer start position.

9 Claims, 10 Drawing Sheets

ROLLER OFFSET PRINTING APPARATUS

BACKGROUND OF THE INVENTION

The present invention relates to an apparatus for printing a color superposition image, and particularly relates to a roller offset printing apparatus adapted to production of patterns such as liquid crystal color filter patterns, exposure mask patterns, liquid crystal shadow mask patterns, etc.

Referring to FIGS. 12 and 13, there is shown a conventional roller offset printing apparatus which has a roller transfer drum 101 covered with a rubber sheet and adapted to be rotated by a rotation motor 102, a linear stage 103, pinions 101*a* and 101*b* provided at opposite ends of the roller transfer drum 101, racks 103*a* and 103*b* provided at opposite side edges of the linear stage 103 so as to be engaged with the pinions 101*a* and 101*b* respectively, a master plate 106 and a work plate 107 disposed at a predetermined interval on the linear stage 103, and ink pits 121 (the diagrams (*b*) and (*c*) of FIG. 13) for reserving ink in a surface of the master plate 106.

As shown in the diagram (*a*) of FIG. 13, the pinions 101*a* and 101*b* are engaged with the racks 103*a* and 103*b* respectively, so that the roller transfer drum 101 moves while rotating on the linear stage 103 when the rotation motor 103 is driven. When the roller transfer drum 101 rotates on the surface of the master plate 106, ink 120 in the ink pits 121 is transferred onto the outer circumferential surface of the roller transfer drum 101 (the diagram (*b*) of FIG. 13). When the roller transfer drum 101 further rotates on the surface of the work plate 107, the ink 120 is transferred from the outer circumferential surface of the roller transfer drum 101 onto the surface of the work plate 107 (the diagram (*c*) of FIG. 13).

Thus, the conventional apparatus uses such a driving system that the roller transfer drum 101 is rotated through the engagement between the pinions 101*a* and 101*b* and the racks 103*a* and 103*b* as described above. Accordingly, a displacement may be produced between an original image on the master plate 106 and a printed image on the work plate 107 because of backlash, abrasion, etc. This arouses a problem in superposition printing.

Further, in the conventional apparatus, the roller transfer drum 101 is supported at its opposite ends by sliding bearings, tapering roller bearings, or the like. Accordingly, the rotational resistance of the roller transfer drum is large, so that there is a tendency of sliding of the roller transfer drum on the surface of the master plate 106 or on the surface of the work plate 107. There arises a problem in that transmission of movement cannot be made sufficiently.

Furthermore, in the conventional apparatus shown in FIG. 12, the distance between the master plate 106 and the work plate 107 is determined on the basis of the diameter of the roller transfer drum 101. That is, the distance is determined so that the rotation angular position of the roller transfer drum 101 in a first transfer start position where the roller transfer drum 101 is brought into contact with the surface of the master plate 106 so as to start to move while rotating on the surface of the master plate 106 in order to transfer the ink 120 in the ink pits (patterned recesses) in the surface of the master plate 106 onto the outer circumferential surface of the roller transfer drum 101 is made to coincide with the rotation angular position of the roller transfer drum 101 in second transfer start position where the roller transfer drum 101 starts to move while rotating on the surface of the work plate 107 in order to transfer the ink from the outer circumferential surface of the roller transfer drum 101 onto the surface of the work plate 107. Accordingly, when the diameter of the drum is changed, the rotation angular positions of the roller transfer drum 101 in the two transfer start positions are shifted from each other. As a result, there arises a problem in that the pattern (the ink 120 in the patterned recesses 121) in the surface of the master plate 106 is printed in a different position of the surface of the work plate 107. Accordingly, in the conventional apparatus, the printing start portion of the master plate 106 becomes different from the printing start position of the work plate 107 if the drum is changed in diameter.

If a position adjusting mechanism for changing the distance between the master plate 106 and the work plate 107 in accordance with the drum diameter is provided for the two plates, the drum diameter can be changed in the conventional apparatus. In this case, however, there arises a problem in that not only the size of the apparatus as a whole increases but the cost of production thereof increases.

SUMMARY OF THE INVENTION

The present invention is attained in such circumstances and an object thereof is to provide a roller offset printing apparatus adapted to superposition printing.

In addressing the foregoing object, according to an aspect of the present invention, the roller offset printing apparatus comprises: a linear stage movable forwards and backwards; a stage driving means for driving the linear stage; a master plate and a work plate disposed at a predetermined interval on the linear stage, the master plate having ink pits formed in a surface of the master plate for reserving ink; a roller transfer drum supported rotatably; a roller transfer drum driving means for driving the roller transfer drum so that the roller transfer drum rotates on the surface of the master plate to transfer the ink in the ink pits of the master plate onto the outer circumferential surface of the roller transfer drum and the roller transfer drum further rotates on a surface of the work plate to thereby transfer the ink from the outer circumferential surface of the roller transfer drum onto the surface of the work plate; static pressure bearings for supporting the roller transfer drum; a rotation force transmission control means for controlling on/off of transmission of rotation force from the roller transfer drum driving means to the roller transfer drum; a rotation angle detection means for detecting the rotation angle of the roller transfer drum; and a transfer control means for turning off the rotation force transmission control means at the time of start of transfer to thereby cut off transmission of the rotation force from the roller transfer drum driving means to the roller transfer drum and for turning on the rotation force transmission control means at the time of completion of transfer to thereby return the roller transfer drum to a transfer start position.

Because the rotation force transmission control means is turned off at the time of start of transfer to thereby cut off transmission of the rotation force from the roller transfer drum driving means to the roller transfer drum, the roller transfer drum supported by the static pressure bearings comes into a free state so that the roller transfer drum can be rotated by friction force produced between the surface of the roller transfer drum and the surface of the master plate or the surface of the work plate as the linear stage moves linearly. Further, the rotation force transmission control means is turned on at the time of completion of transfer so that the roller transfer drum is returned to a transfer start position while supervised by the rotation angle detection means.

DESCRIPTION OF THE PREFERRED EMBODIMENTS

Embodiments of the present invention will be described below with reference to the drawings.

Figure 1:
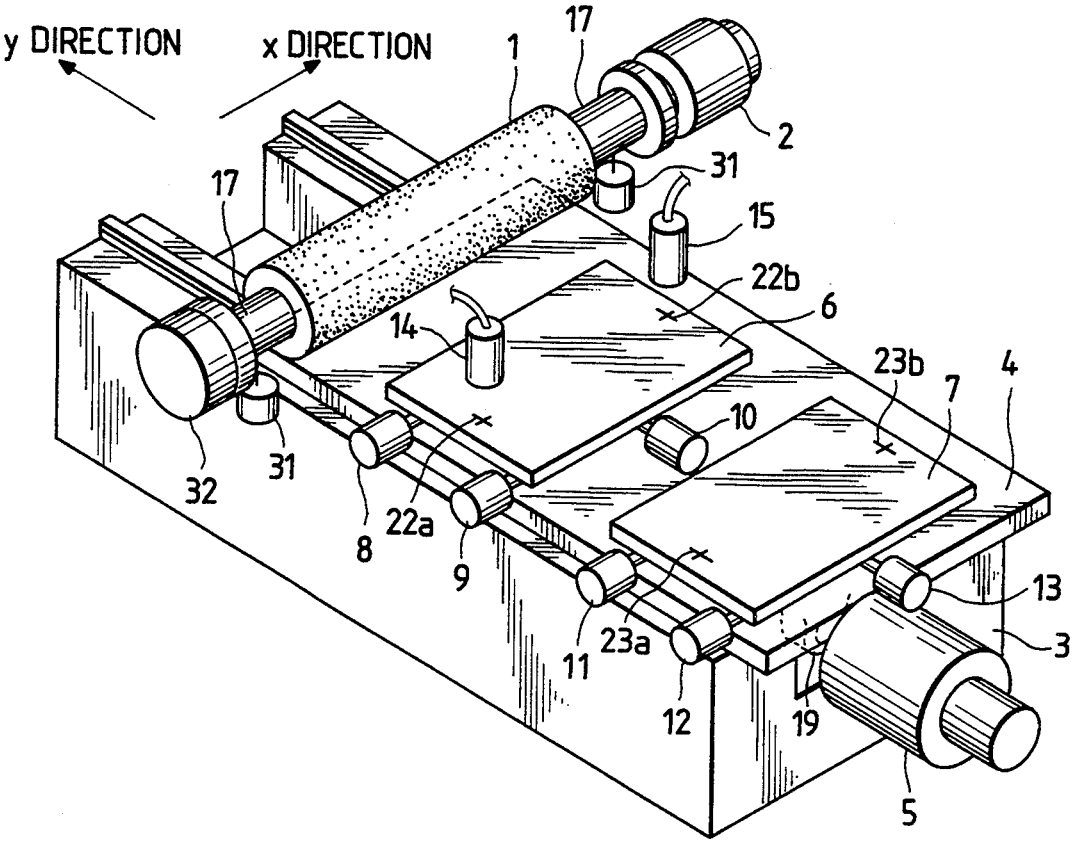
FIG. 1 is a perspective view of a roller offset printing apparatus according to an embodiment of the present invention.

Referring to FIGS. 1 through 8, an embodiment of the present invention will be first described. FIG. 1 is a perspective view showing an embodiment of the roller offset printing apparatus according to the present invention. In the drawing, the reference numeral 1 designates a roller transfer drum; 2, a roller transfer drum motor; 3, a base; 4, a linear stage provided on the base 3; 5, a linear stage motor; 6, a master plate provided at a predetermined position on the linear stage 4; 7, a work plate provided at a predetermined position on the linear stage 4; 8 to 10, master plate side motors; 11 to 13, work plate side motors; and 14 and 15, image sensors.

Figure 3:
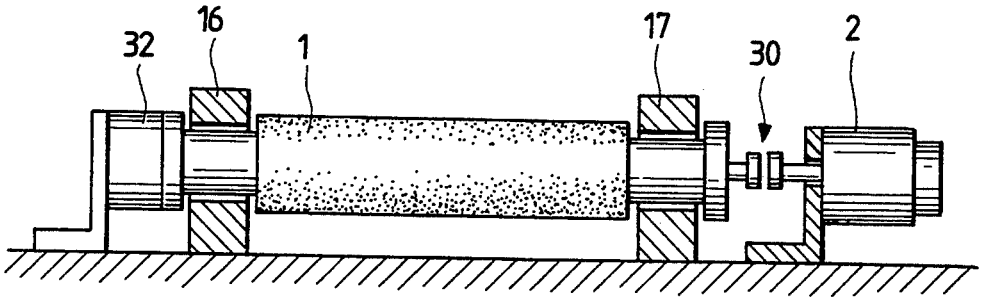
FIG. 3 is a sectional view showing the relationship in connection between the roller transfer drum and the roller transfer drum motor.
Figure 5:
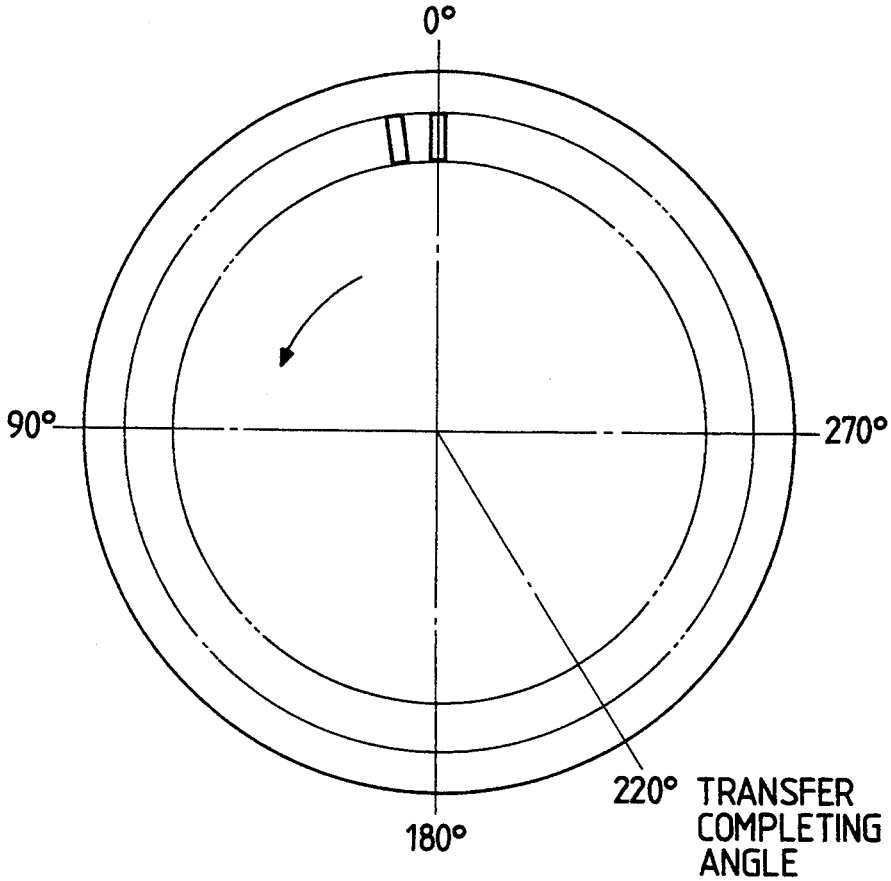
FIG. 5 is a view showing a disk of an encoder.
Figure 6:
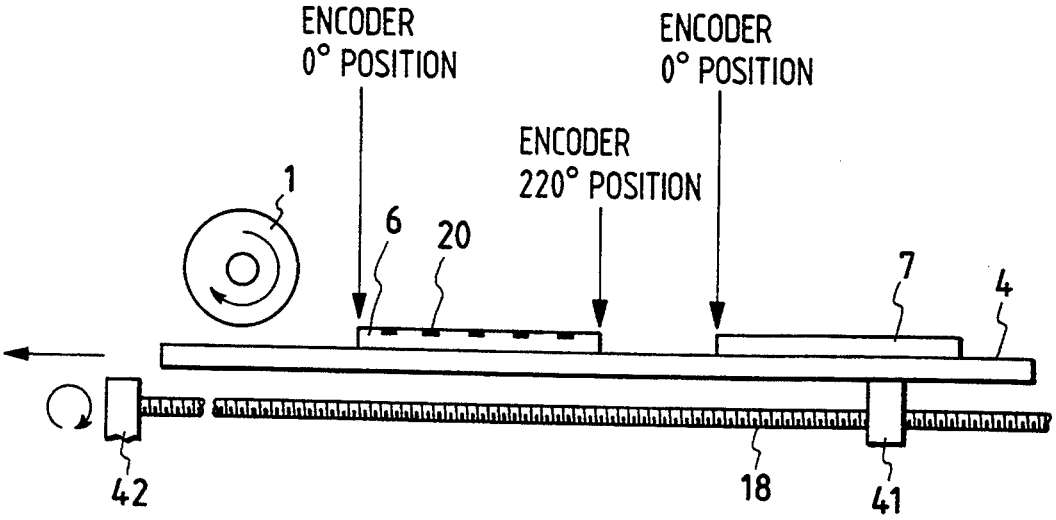
FIG. 6 is a view for explaining the function of the encoder.
Figure 12:
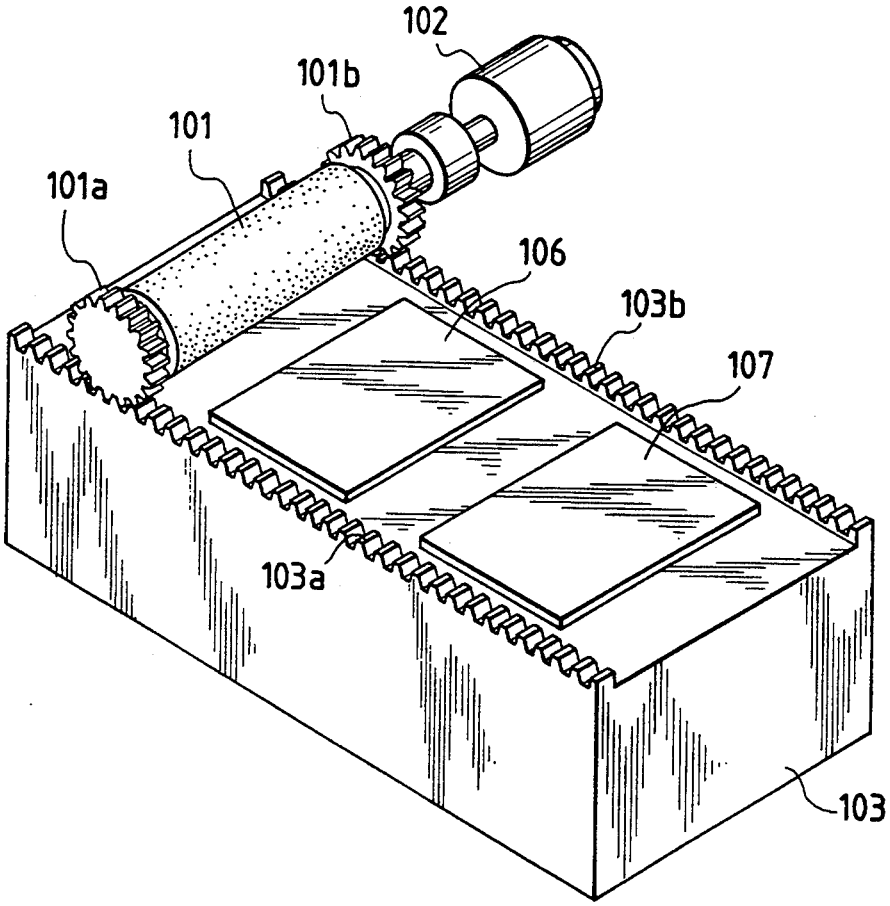
FIG. 12 is a perspective view of a conventional roller offset printing apparatus.
Figure 7:
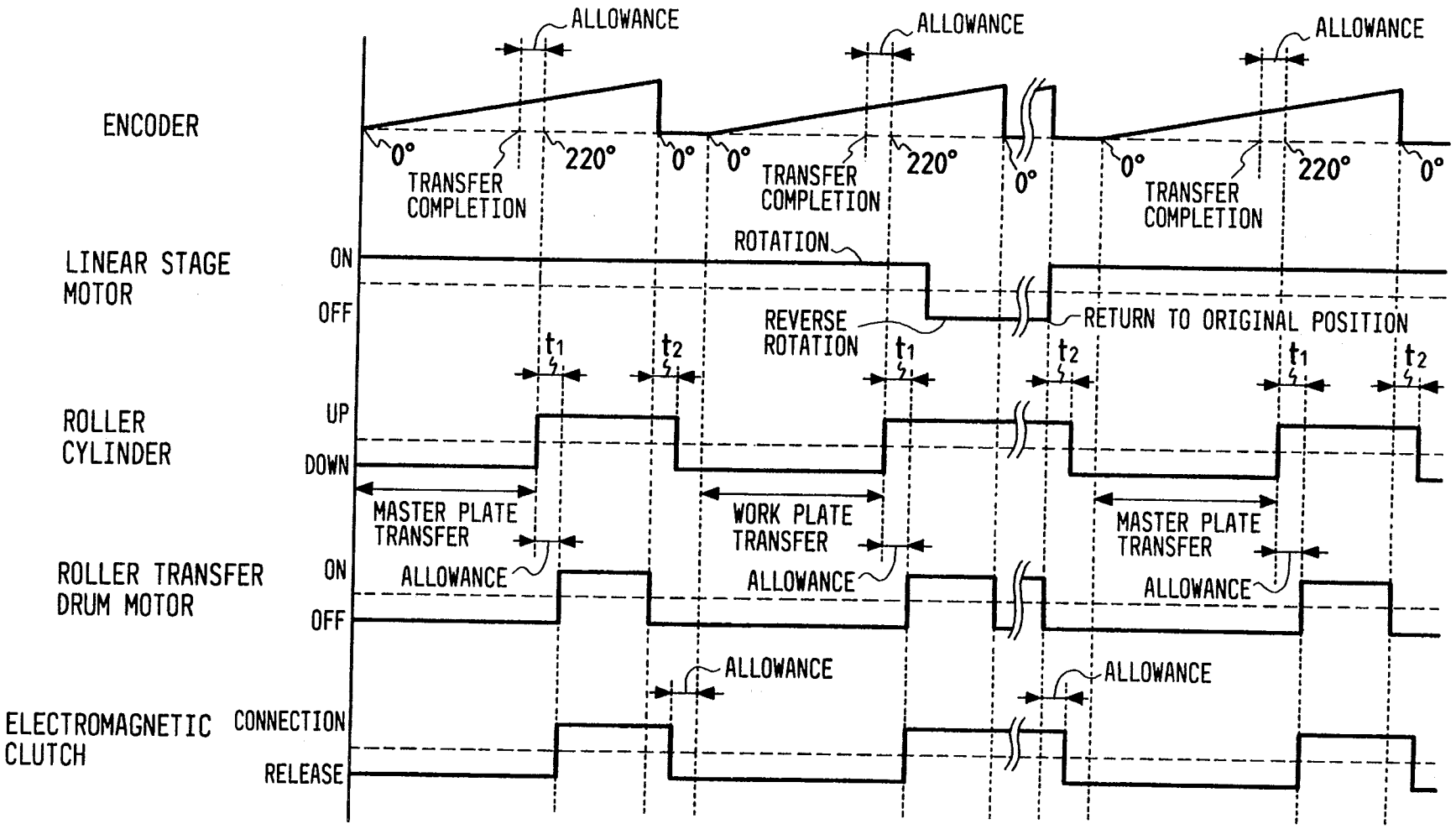
FIG. 7 is a timing chart for explaining the operation of the roller offset printing apparatus.

The roller transfer drum 1 is covered with a rubber sheet and rotatably supported at its opposite ends by air static pressure bearings 16 and 17. An encoder 32 is attached to the bearing 16 side end of the roller transfer drum 1. As specifically shown in FIG. 4, the air static pressure bearing 16 (17, not shown in FIG. 4) is provided with supply passage 16*a* (17*a*, not shown in FIG. 4) through which air is supplied to a gap between the outer circumference of the rotary shaft of the roller transfer drum 1 and the inner circumference of the bearing 16 (17, not shown in FIG. 4) in order to reduce rolling friction of the roller transfer drum 1 at the time of transfer. Roller cylinders 31 are connected to the air static pressure bearings 16 and 17 respectively so that the air static pressure bearings 16 and 17 can be moved up and down perpendicularly to a surface of the linear stage 4. Each of the roller cylinders 31 has a limit switch (not shown) for detecting the transfer position of the roller transfer drum 1. The encoder 32 serves to detect the rotation position of the roller transfer drum 1. When a disk shown in FIG. 5 is rotated from a transfer rotating start position at an angle 0° to a transfer rotating end position at an angle 220°, the roller transfer drum 1 is moved up away from the master plate 6 by the roller cylinders 31, and, then, when the roller transfer drum 1 is returned to the 0° position by the roller transfer drum motor 2 and brought into contact with the work plate 7, an electromagnetic clutch 30 is released (FIG. 6). The bearing 17 side end of the roller transfer drum 1 is coupled, through the electromagnetic clutch 30, to the rotary shaft of the roller transfer drum motor 2 acting as a roller transfer drum driving means (FIG. 3).

Between the linear stage 4 and the base 3, there is provided a stage driving means constituted by a driving screw 18 connected to the rotary shaft of the linear stage motor 5 mounted on the base 3, a nut 19 thread-engaged with the driving screw 18, a support member 41 attached to the linear stage 6 to support the nut 19, and another support member 42 attached to the base 3 to rotatably support the driving screw 18.

Figure 8A:
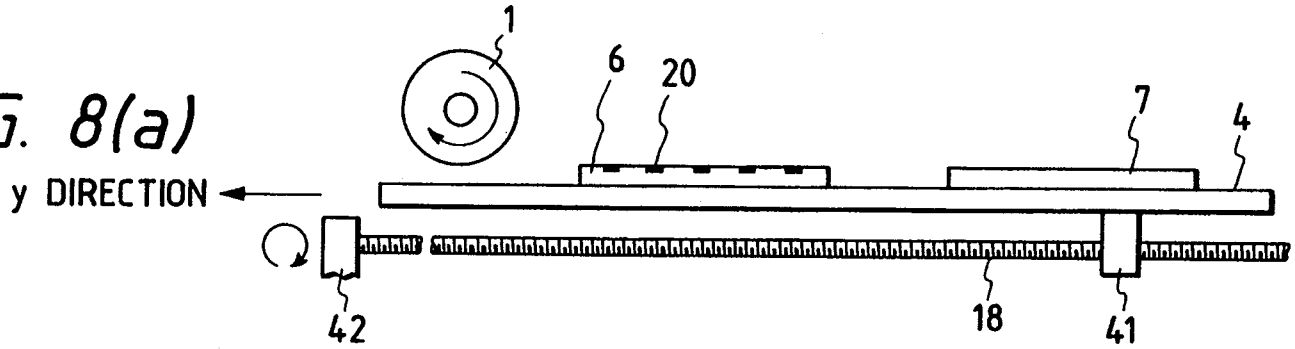
FIG. 8(*a*)–8(*c*) are views for explaining the operation of the roller offset printing apparatus.
Figure 8B:
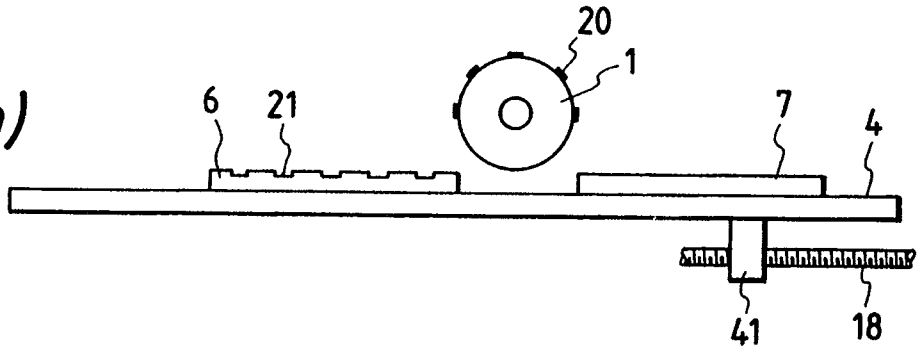
Figure 8C:
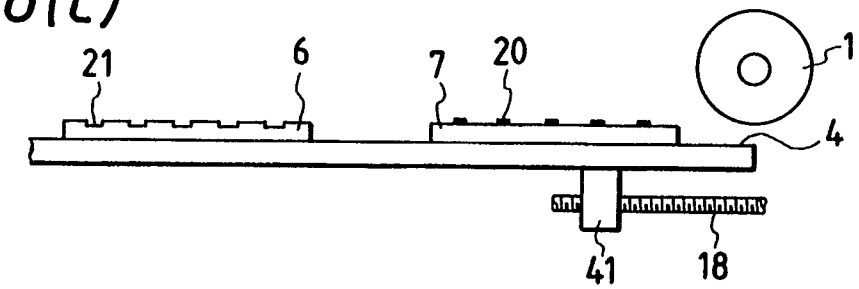

The master plate 6 is made of glass and provided with ink pits 21 (the diagram (*b*) of FIG. 8) which are formed in a surface of the master plate 6 so as to reserve ink 20 therein. The ink 20 is injected into the ink pits 21 through an ink jet, a doctor brush, a wiper spatula or the like. Further, alignment marks 22*a* and 22*b* for correcting positional displacement are exhibited on the surface of the master plate 6. In the periphery of the master plate 6, not only the master plate side motors 8 and 9 are provided for moving the master plate 6 in an x-direction but a master plate side motor 10 is provided for moving the master plate 6 in a y-direction.

The work plate 7 is made of a material such as glass, aluminum, etc. Alignment marks 23*a* and 23*b* for correcting positional displacement are exhibited on the surface of the work plate 7. In the periphery of the work plate 7, not only work plate side motors 11 and 12 are provided for moving the work plate 7 in the x-direction but a work plate side motor 13 is provided for moving the work plate 7 in the y-direction.

Figure 2:
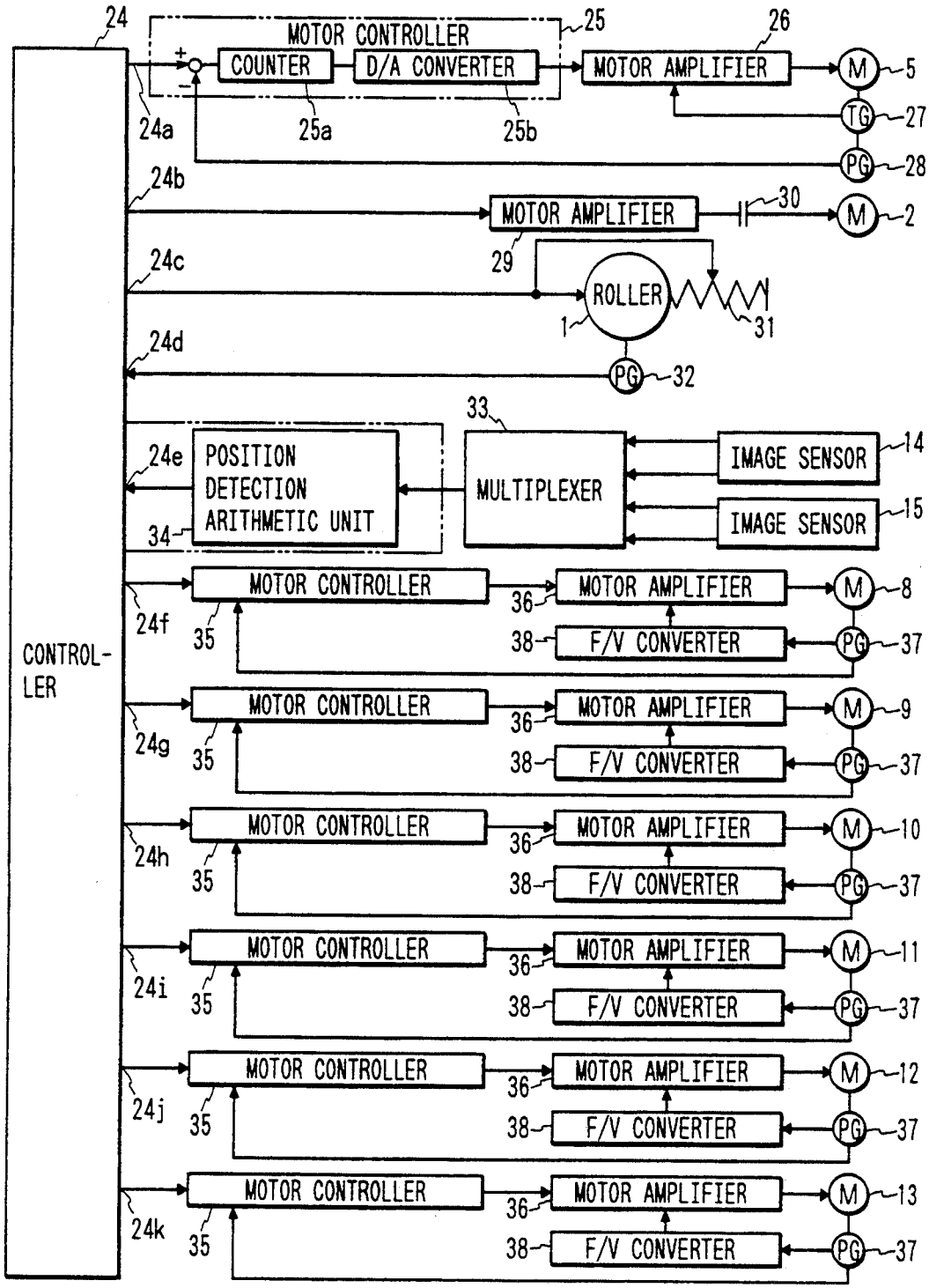
FIG. 2 is a block diagram of the roller offset printing apparatus.
Figure 4:
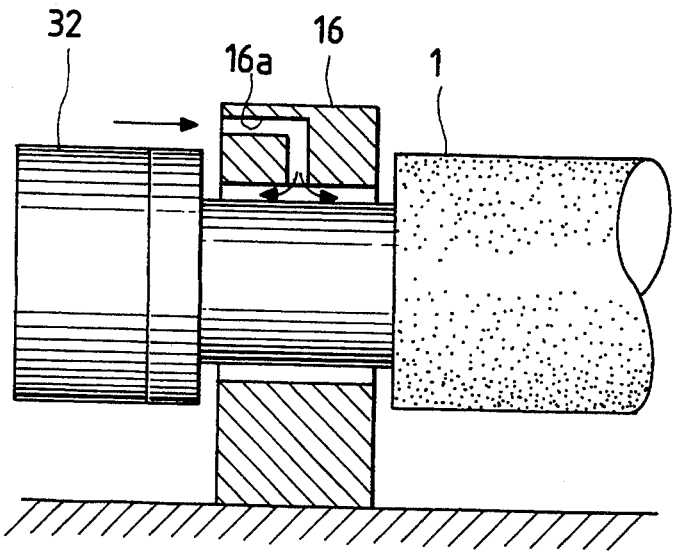
FIG. 4 is a sectional view of a static pressure bearing.

FIG. 2 is a block diagram of the roller offset printing apparatus. In the drawing, the reference numeral 24 designates a controller. The linear stage motor 5 is connected to an output terminal 24*a* of the controller 24 through a motor controller 25 and a motor amplifier 26. The motor controller 25 has a counter 25*a* for comparing a moving instruction signal supplied from the controller 24 with a position signal supplied from an encoder (pulse generator) 28, and a D/A converter 25*b* for converting a deviation as a result of the comparison into an analog quantity. After D/A conversion, the moving instruction signal is amplified by the motor amplifier 26 so that the linear stage motor 5 is driven on the basis of the amplified signal. The encoder 28 is provided for moving the linear stage 4 to a predetermined position while checking the current position of the linear stage 4 on the basis of position information. A tachometer generator 27 applies a voltage change generated in accordance with the rotational speed of the linear stage motor 5 to the motor amplifier 26 to thereby control the voltage (speed) so as to be kept constant.

The roller transfer drum motor 2 is connected to another output terminal 24*b* of the controller 24 through a motor amplifier 29 and the electromagnetic clutch 30. The electromagnetic clutch 30 serves as a coupler for connecting/disconnecting the rotary shaft of the roller transfer drum motor 2 and the rotary shaft of the roller transfer drum 1.

The roller cylinders 31 for moving up and down the roller transfer drum 1 are connected to a further output terminal 24*c* of the controller 24. The rotation angle of the roller transfer drum 1 is detected by the encoder 32, and an output signal from the encoder 32 is supplied as a rotation angle signal to an input terminal 24*d* of the controller 24.

The image sensors 14 and 15 are connected to another input terminal 24*e* of the controller 24 through a multiplexer 33 and a position detection arithmetic unit 34. The quantities of displacement of the alignment marks 22*a*, 22*b*, 23*a* and 23*b* on the master plate 6 and the work plate 7 are read successively from position detection signals of the image sensors 14 and 15 by the position detection arithmetic unit 34 (while being switched by the multiplexer 33), and an output signal from the arithmetic unit 34 is supplied as an alignment signal to the controller 24.

The master plate side motor 8 is connected to a further output terminal 24*f* of the controller 24 through a motor controller 35 and a motor amplifier 36. The motor controller 35 compares the alignment signal supplied from the controller 24 with a signal supplied from an encoder 37 and converts a deviation between the signals into an analog quantity. After D/A conversion, the alignment signal is amplified by the motor amplifier 36 so that the master plate side motor 8 is driven on the basis of the amplified signal. An F/V converter 38 converts a signal frequency supplied from the encoder 37 into a voltage and gives the voltage as a feedback signal to the motor amplifier 36 to thereby control the voltage so as to be kept constant.

Circuits for driving the master plate side motors 9 and 10 can be formed in the same manner as in the aforementioned circuits, and the description thereof will be omitted. By the same reason, the description of circuits for driving the work plate side motors 11 to 13 will be omitted.

The operation of the roller offset printing apparatus in this embodiment will, be described below.

When the linear stage motor 5 is driven, the driving screw 18 is rotated so that the linear stage 4 is guided by the driving screw 18 so as to move in the y-direction in FIG. 1. At the same time, the master plate 6 on the linear stage 4 is moved and once stopped at a position where the image sensors 14 and 15 and the alignment marks 22*a* and 22*b* are in position to each other respectively.

The quantities of displacement (x-direction displacement and y-direction displacement) of the alignment marks 22*a* and 22*b* on the master plate 6 from predetermined positions are detected on the basis of optical signals from the image sensors 14 and 15 and read by the position detection arithmetic unit 34, and an output signal of the arithmetic unit 34 is supplied as an alignment signal to the controller 24.

When the alignment signal is supplied from the controller 24 to the master plate side motors 8 to 10, the master plate side motor 8 to 10 are driven on the basis of the alignment signal. As a result, the quantities of displacement of the master plate 6 are corrected so that the master plate 6 can be placed in a correct position.

Thereafter, the linear stage 4 is moved by a predetermined reference quantity in the y-direction in FIG. 1 so that the work plate 7 is stopped at a position where the image sensors 14 and 15 and the alignment marks 23*a* and 23*b* are in opposition to each other respectively. Then, the quantities of displacement of the alignment marks 23*a* and 23*b* on the work plate 7 are detected and read by the position detection arithmetic unit 34 and an output signal of the arithmetic unit 34 is supplied as an alignment signal to the controller 24.

When the alignment signal is supplied from the controller 24 to the work plate side motors 11 to 13, the work plate side motor 11 to 13 are driven on the basis of the alignment signal. As a result, the quantities of displacement of the work plate 7 are corrected so that the work plate 7 can be placed in a correct position.

After correction of each positions of the master plate 6 and the work plate 7 and injection of ink, the roller cylinders 31 are moved down in such a manner that the master plate 6 is brought in contact with the roller transfer drum 1 at a first transfer start position on which an ink transfer operation from the master plate 6 to the roller transfer drum 1 (first transfer operation) is started. On the first transfer operation start position, a rotating position of the roller transfer drum 1 is set at 0°. At this time the electromagnetic clutch 30 is released, so that the roller transfer drum 1 comes into contact with the surface of the master plate 6 and rotates as the linear stage 4 moves. When the roller transfer drum 1 rotates by 220°, the roller cylinders 31 are actuated to move up the roller transfer drum 1. When the roller transfer drum 1 rotates while being in contact with the surface of the master plate 6, the ink 20 in the ink pits 21 is transferred onto the outer circumferential surface of the roller transfer drum 1 (the diagram (*b*) of FIG. 8). With the passage of a predetermined time ($t_1$) after the moving-up of the roller transfer drum 1, the electromagnetic clutch 30 is turned on so that the rotation force of the roller transfer drum motor 2 is transmitted to the roller transfer drum 1. As a result, the roller transfer drum 1 rotates. When the roller transfer drum 1 moves so that the encoder 32 detects the 0° position, the roller transfer drum motor 2 is stopped and then the electromagnetic clutch 30 is released. With the passage of a predetermined time ($t_2$) after detection of the 0° position of the roller transfer drum 1, the roller cylinders 31 are actuated to move down the roller transfer drum 1. At this time, the controller 24 controls in such a manner that the work plate 7 is brought in contact with the roller transfer drum 1 at a second transfer start position on which an ink transfer operation from the roller transfer drum 1 to the work plate 7 (second ink transfer operation) is started. When the surface of the work plate 7 is brought into contact with the roller transfer drum 1, the roller transfer drum 1 is started to rotate as the linear stage 4 moves because the linear stage 4 is still moving in the y-direction in FIG. 1. When the roller transfer drum 1 rotates by 220°, the roller cylinders 31 is actuated to move up the roller transfer drum 1. At the same time, the electromagnetic clutch 30 is turned on so that the roller transfer drum 1 is returned to the original 0° position. When the roller transfer drum 1 rotates on the surface of the work plate 7, the ink 20 is transferred from the outer circumferential surface of the roller transfer drum 1 onto the surface of the work plate 7 (the diagram (*c*) of FIG. 8). After completing a roller offset printing operation comprising the first and second transfer operations, the linear stage 4 is suspended and returned to a start position.

Now, another embodiment of the roller offset printing apparatus according to the present invention will be described below with reference to FIGS. 9 through 11. In the description of this embodiment, the parts the same as those in the previous embodiment are referenced correspondingly.

Figure 9:
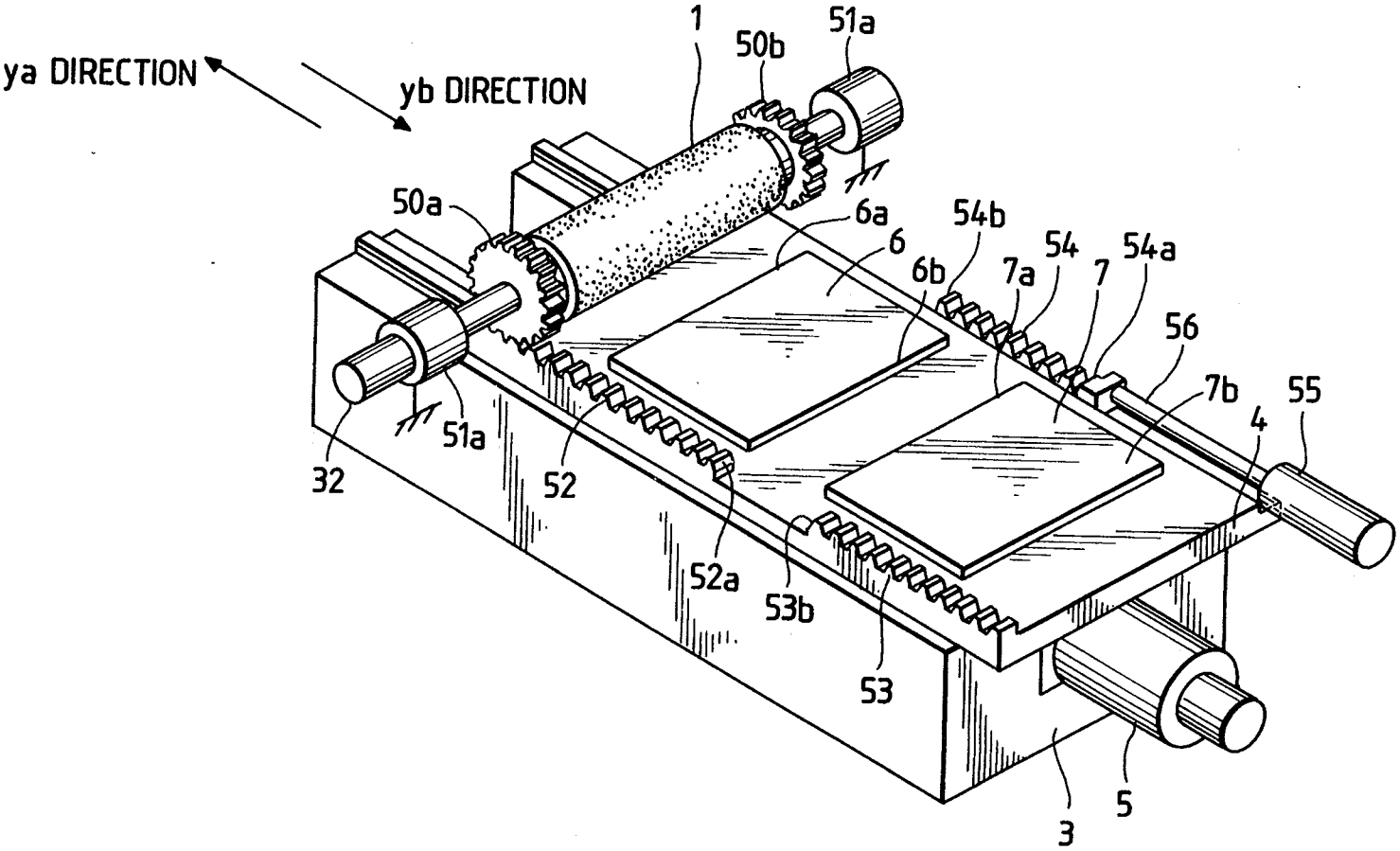
FIG. 9 is a perspective view of a roller offset printing apparatus according to another embodiment of the present invention.

In the embodiment shown in FIG. 9, the above-mentioned problem caused in the case where the roller transfer drum is changed in diameter can be solved.

FIG. 9 shows the other embodiment of the roller offset printing apparatus according to the present invention. In this embodiment, the roller offset printing apparatus has a roller transfer drum (blanket drum) 1 provided with pinions 50*a* and 50*b* at its opposite ends and supported by bearings 51*a* and 51*a*, a linear stage 4 provided with racks 52 and 53 capable of being engaged with the pinion 50*a* so as to be driven in the ya- and yb-directions by a linear stage motor 5, a slide rack 54 slidably mounted on the stage 4, and an actuator 55 for moving the slide rack 54 in the ya- and yb-directions on the stage 4.

The rack 52 is long enough to move the roller transfer drum 1 from an end portion 6*a* of the master plate 6 to the other end portion 6*b* of the same as the stage 4 driven by the motor 5 moves in the ya-direction. Similarly, the rack 53 is long enough to move the roller transfer drum 1 from an end portion 7*a* of the work plate 7 to the other end portion 7*b* of the same as the stage 4 moves as described above. An end portion 52*a* of the rack 52 is positioned so that the rack 52 is disengaged from the pinion 50*a* of the roller transfer drum 1 in a position where the roller transfer drum 1 is slightly away from the end portion 6*b* of the master plate 6. On the other hand, an end portion 53*b* of the rack 53 is positioned so that the rack 53 is engaged with the pinion 50*a* just before the roller transfer drum 1 is brought into contact with the end portion 7*a* of the work plate 7.

The actuator 55 is constituted, for example, by an air pressure cylinder. A forward end portion of a driving arm 56 of the actuator is connected to an end portion 54*a* of the slide rack 54. The actuator 55 is formed so that the slide rack 54 is moved in the ya-direction in FIG. 9 from the original position in FIG. 9 by the driving arm 56 when operation pressure is supplied, and the slide rack 54 is returned from the displacement position to the original position by the driving arm 56 when the operation pressure is removed.

Figure 10A:
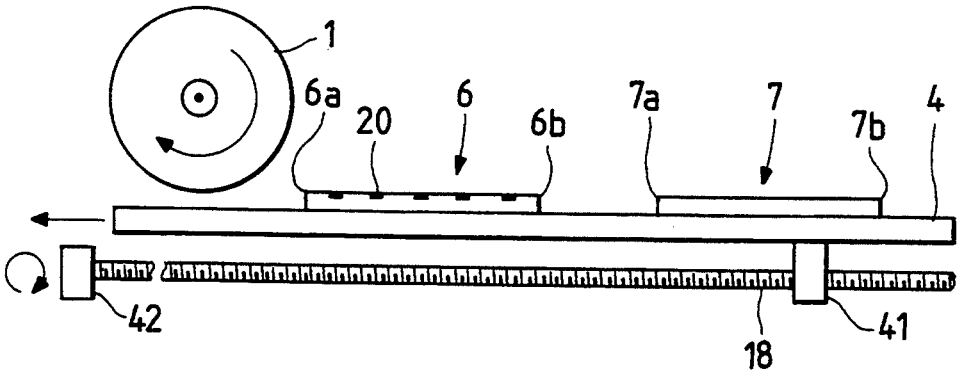
FIGS. 10(*a*)–10(*c*) are views for explaining the operation of the roller offset printing apparatus according to the other embodiment.
Figure 10B:
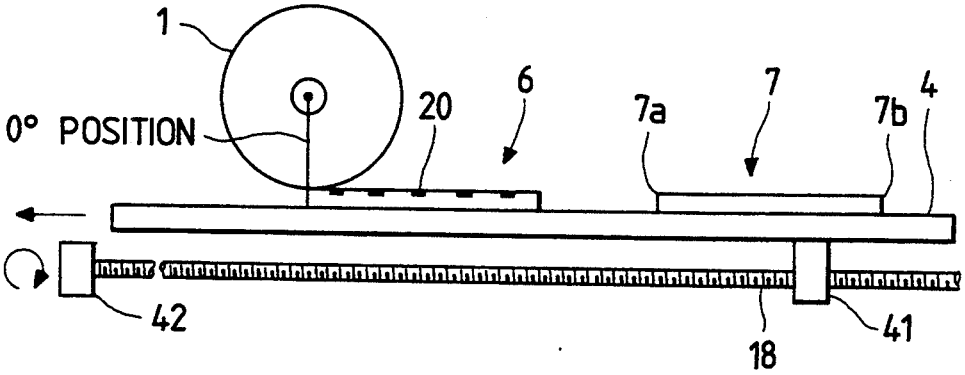
Figure 10C:
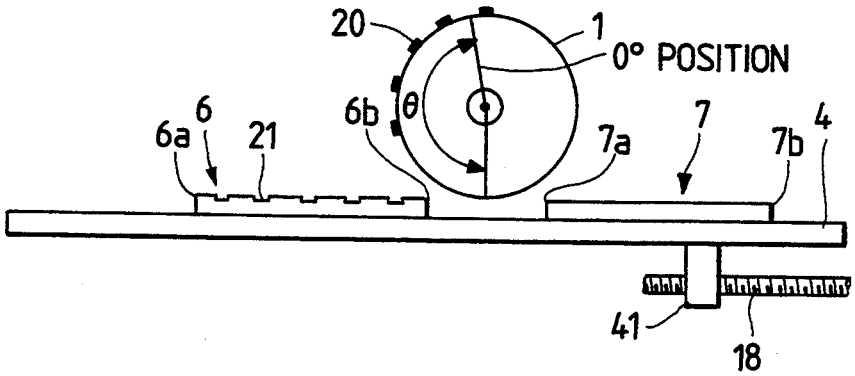
Figure 11A:
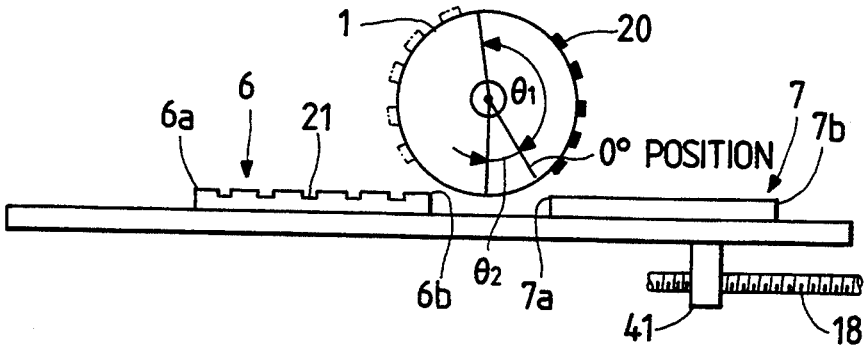
FIGS. 11(*a*)–11(*c*) are views for explaining the operation of the roller offset printing apparatus according to the other embodiment.
Figure 11B:
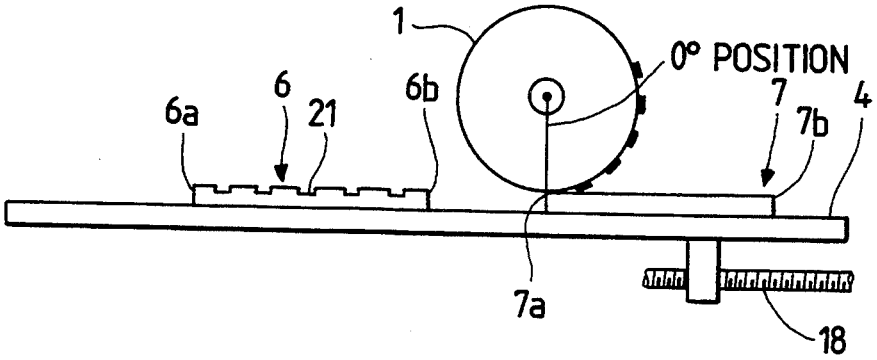
Figure 11C:
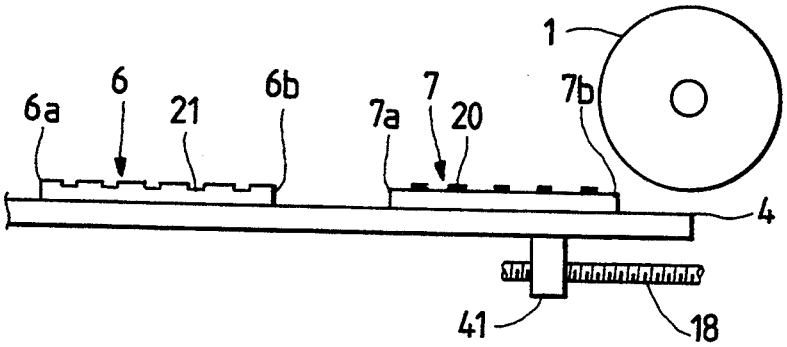
Figures 13A, 13B, 13C:
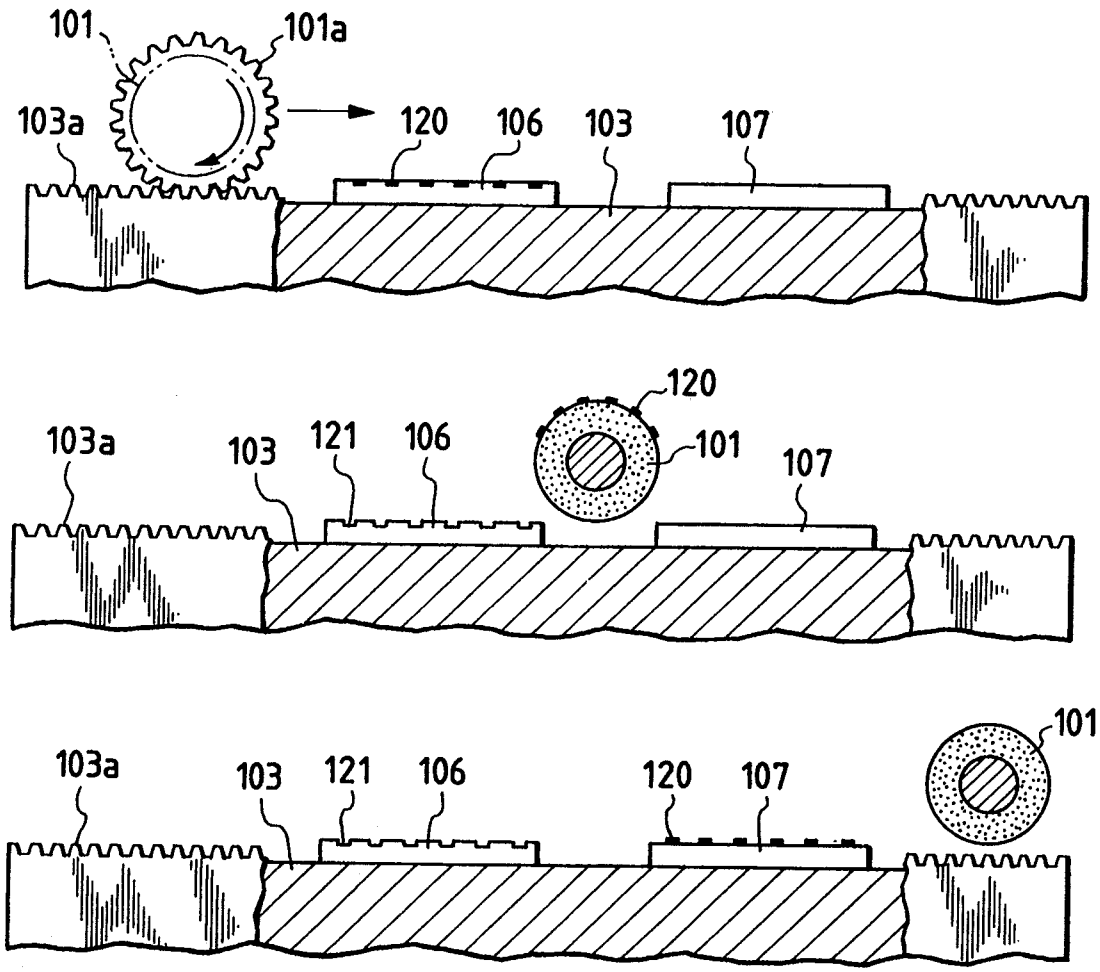
FIGS. 13(*a*)–13(*c*) are views for explaining the operation of the conventional roller offset printing apparatus.

When the rotation angular position of the roller transfer drum 1 in a first transfer start position (the position in the diagram (*b*) of FIG. 10) where the transfer drum 1 is brought into contact with the surface of the master plate 6 and starts to move in,the ya-direction while rotating on the surface of the master plate 6 in order to transfer the ink pits (patterned recesses) 21 (see the diagram (*c*) of FIG. 10) in the surface of the master plate 6 onto the outer circumferential surface of the roller transfer drum 1 is defined as a reference angular position (0° position), the slide rack 54 is provided to make the transfer drum 1 slip so that the rotation angular position of the transfer drum 1 in a second transfer start position (the position in the diagram (*b*) of FIG. 11) where the transfer drum 1 is brought into contact with the surface of the work plate 7 and starts to move in the ya-direction while rotating on the surface of the work plate 7 in order to transfer the ink which has been transferred onto the outer circumferential surface of the roller transfer drum 1 to the surface of the work plate 7 can be made to coincide with the reference angular position (the 0° position). When the slide rack 54 is in the original position, the other end position 54*b* of the slide rack 54 is in a position where the slide rack 54 is engaged with the pinion 50*b* of the roller transfer drum 1 just before the pinion 50*a* is disengaged from the end portion 52*a* of the rack 52. When the roller transfer drum 1 is in a position between the end portion 6*b* of the master plate 6 and the end portion 7*a* of the work plate 7, that is, when the roller transfer drum 1 is in an intermediate position (the position in the diagram (*c*) of FIG. 10 and in the diagram (*a*) of FIG. 11) where the pinion 50*a* is disengaged from the two racks 52 and 53, the slide rack 54 is moved by a predetermined slide quantity S in the ya-direction from the original position by the actuator 55 in the condition that the stage 4 is stopped to thereby make the pinion 50*b* engaged with the slide rack 54 race, that is, make the roller transfer drum 1 race by a predetermined correction angle $\theta_1$ (see the diagram (*a*) of FIG. 11). At the same time, the slide rack 54 is long enough to make the transfer drum 1 to further move while rotating by a predetermined angle $\theta_2$ (see the diagrams (*a*) and (*b*) of FIG. 11) till the roller transfer drum 1 comes into contact with the end portion 7*a* of the work plate 7 when the stage 4 is moved again in the ya-direction after the racing. The slide rack 54 preferably has a module equal to those of the racks 52 and 53.

Also in this embodiment, the linear stage motor 5 is configured so as to be controlled by a controller 24 through a motor controller 25, a motor amplifier 26, a tachometer generator 27 and an encoder 28 in the same manner as in the previous embodiment.

In this embodiment, the controller 24 is configured so that not only the motor 5 is stopped to thereby stop the ya-direction movement of the stage 4 when the roller transfer drum 1 reaches the intermediate position, but the motor 5 is driven again to thereby restart the ya-direction movement of the stage 4 after the roller transfer drum 1 is raced by a predetermined correction angle $\theta_1$ as described above.

The rotation angular position of the roller transfer drum 1 is detected by the encoder 32 and supplied to the controller 24 so that the operation of the arm 56 is controlled by the controller 24.

In this embodiment, the controller 24 is configured to control the operation pressure supplied to the actuator 55 in a manner as follows. The rotation angular position of the transfer drum 1 which is detected by the encoder 32 when the roller transfer drum 1 reaches the first transfer start position (position in the diagram (*b*) of FIG. 10) is stored preliminarily as a reference angular position (0° position). A correction angle $\theta_1$ is calculated on the basis of the rotation angle $\theta$ of the transfer drum 1 between the first transfer start position in the diagram (*b*) of FIG. 10 and the intermediate position in the diagram (*c*) of FIG. 10 and the predetermined angle $\theta_2$. The predetermined correction slide quantity S is calculated in accordance with the correction angle $\theta_1$. Operation pressure is calculated in accordance with the correction slide quantity S. A control signal expressing the operation pressure is supplied to a driver not shown to thereby control the operation pressure supplied to the actuator 55.

The operation of the embodiment having the above-mentioned configuration will be described below with reference to the diagrams (*a*) through (*c*) of FIG. 10 and the diagrams (*a*) through (*c*) of FIG. 11.

First, when the linear stage 4 is driven by the linear stage motor 5 so as to be moved in the ya-direction as shown in the diagram (*a*) of FIG. 10, the pinion 50*a* is engaged with the rack 52. With the ya-direction movement of the linear stage 4, the roller transfer drum 1 reaches the first transfer start position where the roller transfer drum 1 is brought into contact with the end portion 6*a* of the master plate 6 because the roller transfer drum 1 is supported by the bearings 51*a* and 51*a* as shown in the diagram (*b*) of FIG. 10.

The rotating position of the roller transfer drum 1 at this first transfer start position is set as a reference angular position (0°). When the linear stage 4 is further moved in the ya-direction, the roller transfer drum 1 rotates while being kept in contact with the master plate 6 in accordance with the movement of the stage 4. As a result, the ink 20 in the ink pits 21 is transferred to the outer circumferential surface of the roller transfer drum 1.

When the linear stage 4 is further moved in the ya-direction after completion of transferring of the ink from the master plate 6 onto the roller transfer drum 1, the pinion 50 is disengaged from the rack 52 at an end 52*a* of the rack 52.

In the position where the pinion 50*a* is disengaged from the rack 52 at an end 52*a* of the rack 52, the slide rack 54 has been already positioned by the actuator 55 in the above-mentioned original position where the other end 54*b* of the slide rack 54 is engaged with the pinion 50*b*. Accordingly, the roller transfer drum 1 rotates while the slide rack 54 is engaged with the pinion 50*b* in accordance with the ya-direction movement of the linear stage 4. As a result, the roller transfer drum 1 comes to the above-mentioned intermediate position shown in the diagram (*c*) of FIG. 10. The linear stage 4 is stopped in the intermediate position.

The controller 24 calculates the above-mentioned correction angle $\theta_1$ (see the diagram (*a*) of FIG. 11) on the basis of the rotation angle $\theta$ of the roller transfer drum 1 from the first transfer start position in the diagram (*b*) of FIG. 10 to the intermediate position and the predetermined constant angle $\theta_2$ (see the diagram (*a*) of FIG. 11). The controller 24 calculates the above-mentioned correction slide quantity S of the slide rack 54 on the basis of the calculated correction angle $\theta_1$ to thereby drive the actuator 55 to slide. Accordingly, the roller transfer drum 1 is made to race by the correction angle $\theta_1$ in the intermediate position as shown in the diagram (*a*) of FIG. 11.

When the linear stage 4 is moved again in the ya-direction after the racing, the pinion 50*b* of the roller transfer drum 1 is engaged with the slide rack 54 so as to rotate. Then, the pinion 50*a* is engaged with the rack 53 at the end portion 53*b* of the rack 53 just before the roller transfer drum 1 is brought into contact with the end portion 7*a* of the work plate 7.

After the engagement, the roller transfer drum 1 reaches the second transfer start position (the diagram (*b*) of FIG. 11) where the roller transfer drum 1 is brought into contact with the end 7*a* of the work plate 7. In the movement of the roller transfer drum 1 from the intermediate position to the second transfer start position, the roller transfer drum 1 rotates by the above-mentioned constant angle $\theta_2$.

When the linear stage 4 is further moved in the ya-direction after the roller transfer drum 1 reaches the second transfer start position, the ink on the roller transfer drum 1 is transferred onto the surface of the work plate 7. Thus, the transferring is completed (the diagram (*c*) of FIG. 11).

In the above-mentioned embodiment of the roller printing apparatus according to the present invention, the slide rack 54 in the intermediate position between the end portion 52*a* of the rack 52 and the end portion 53*b* of the rack 53 on the linear stage 4 is driven by the actuator 55 so as to be slid by a correction slide quantity S to thereby make the roller transfer drum 1 race by a correction angle $\theta_1$. As a result, the positioning can be corrected so that the first transfer start position where the roller transfer drum 1 is brought into contact with the master plate 6 in order to start transferring can be set to be in the same reference position (0°) as the second transfer start position where the roller transfer drum 1 is brought into contact with the work plate 7 in order to start transferring.

Accordingly, even in the case where the drum diameter of the roller transfer drum 1 is changed arbitrarily, the positioning can be corrected through calculation of the correction angle $\theta_1$ on the basis of the rotation angle $\theta$ determined in accordance with the drum diameter and the constant angle $\theta_2$. Accordingly, it is unnecessary to provide any position adjusting mechanism for adjusting the position of the master plate and the position of the work plate. It is therefore possible to suppress not only the increase in size of the apparatus as a whole but the increase in production cost.

However, in the above-mentioned embodiment of the roller printing apparatus according to the present invention, when the linear stage 4 is suspended, the slide rack 54 in the intermediate position between the end portion 52*a* of the rack 52 and the end portion 53*b* of the rack 53 on the linear stage 4 is driven by the actuator 55 so as to be slid by a correction slide quantity S to thereby make the roller transfer drum 1 race by a correction angle $\theta_1$. On the other hand, it is not necessary to suspend the linear stage 4. The slide rack 54 may be moved relative to the linear stage 4 so as to be slid by a correction slide quantity S to thereby make the roller transfer drum 1 race by a correction angle $\theta_1$, when the linear stage 4 is moved and the roller transfer drum 1 is located between the end portion 52*a* of the rack 52 and the end portion 53*b* of the rack 53 on the linear stage 4.

Because the drum diameter of the roller transfer drum can be changed arbitrarily, the moment of inertia in the roller transfer drum can be reduced. Further, the drum diameter of the roller transfer drum can be selected so that the distortion of the blanket is minimized. As a result, printing accuracy can be improved.

Although the above-mentioned embodiment shows the case where the linear stage 4 is driven by the motor 5 so as to be moved, the present invention can be applied to the case where the linear stage 4 is provided as a stationary linear stage and the driving motor 2 is provided on the roller transfer drum 1 so that the roller transfer drum 1 is rotated to move on the linear stage 4 by the driving motor 2 in the same manner as in the previous embodiment.

Also in the previous embodiment, the motor 2 is used as a servo motor so as robe subjected to servo control by the controller 24 in a period from a point of time of completion of transferring of the ink from the master plate 6 to the roller transfer drum 1 to a point of time of transferring of the ink from the roller transfer drum 1 to the work plate 7 so that the respective reference angular positions in the first and second transfer start positions of the roller transfer drum 1 can be corrected so as to correspond to each other. Accordingly, even in the case where the drum diameter of the roller transfer drum 1 is changed, such highly accurate printing as free from displacement between the master plate 6 and the work plate 7 can be performed without provision of any position adjusting mechanism for adjusting the relative positions of the master plate 6 and the work plate 7.

Although the above-mentioned embodiment shows the case where an air pressure cylinder is used as the actuator 55, it is to be understood that the present invention is not limited to the specific embodiment and that the material used as the actuator 55 can be selected suitably from an oil pressure cylinder, a combination of oil pressure and air pressure cylinders, a combination of a motor and a feed screw, etc. Further, a mechanical stopper such as an adjusting screw may be used additionally for positioning the original position and the intermediate position.

As described above, according to the roller offset printing apparatus of the present invention, the rotation force transmission control means is released to cut off the transmission of rotation force from the roller transfer drum driving means to the roller transfer drum at the time of the start of transferring. Accordingly, the roller transfer drum supported by static pressure bearings falls into a free state, so that the roller transfer drum is rotated on the basis of friction force produced by contact between the roller transfer drum and the master or work plate in accordance with the linear movement of the linear stage. Further, the rotation force transmission control means is switched on at the time of completion of transferring, so that the roller transfer drum is returned to the transfer start position while supervised by the rotation angle detection means, As a result, phase adjustment in printing can be performed so that the speed of the linear stage can be accurately transmitted to the roller transfer drum. Thus, highly accurate printing can be provided.

In addition, according to the present invention, in the first and second transfer operations, a phase adjustment (synchronism) of the first transfer start position and the second transfer start position is operated easily, so that the roller offset printing with a highly accuracy and a high definition is conducted without having any displacement of the !,X]d patterns.

Further, according to the present invention, the roller transfer drum is never brought in contact with the master plate or the work plate when the linear stage is returned to the start position after completing the roller offset printing, so that it is not necessary to retract the master plate or the work plate, even if a superposition printing is conducted.

Furthermore, according to the present invention, a degree of freedom in a positional relationship between the master plate and the work plate in the linear stage moving direction becomes large, so that the drum diameter of the roller transfer drum 1 can be changed arbitrarily.

While the present invention has been described above with several preferred embodiments thereof, it should of course be understood that the present invention should not be limited only to these embodiments but various change or modification may be made without departure from the scope of the present invention as defined by the appended claims.

What is claimed is:

1. A roller offset printing apparatus including:

a base (3);

a linear stage (4) movable forwards and backwards on said base;

a stage driving means (5) for driving said linear stage;

a master plate (6) and a work plate (7) disposed at a predetermined interval on said linear stage (4), said master plate (6) having ink pits (21) formed in a surface of said master plate (6) for reserving ink (20);

a roller transfer drum (1) supported rotatably; and a roller transfer drum driving means (2, 52, 53) for driving said roller transfer drum (1) so that a roller offset printing including a first transfer operation, in which said roller transfer drum (1) rotates on the surface of said master plate (6) to transfer the ink (20) in said ink pits (21) of said master plate (6) onto the outer circumferential surface of said roller transfer drum (1), and a second transfer operation, in which said roller transfer drum (1) rotates on a surface of said work plate (7) to thereby transfer the ink (20) from the outer circumferential surface of said roller transfer drum (1) onto the surface of said work plate (7), is conducted, wherein said roller offset printing apparatus comprising:

a rotation force transmission control means (30) for controlling on/off of transmission of rotation force from said roller transfer drum driving means (2) to said roller transfer drum (1);

a rotation angle detection means (32) for detecting the rotation angle of said roller transfer drum (1); and a transfer control means (24) for turning off said rotation force transmission control means (30) at the time of start of said first and second transfer operations to thereby cut off transmission of the rotation force from said roller transfer drum driving means (2) to said roller transfer drum (1) and for turning on said rotation force transmission control means (30) after completing one of said first and second transfer operations to thereby return said roller transfer drum (1) to a transfer start position in accordance with an output signal of said rotation angle detection means (32).

2. A roller offset printing apparatus according to claim 1, further comprising:

an alignment mark detecting means (14, 15) for detecting a position of said master plate (6) and said work plate (7); and a master plate adjusting means (8, 9, 10) for adjusting the position of said master plate (6) in accordance with the output of said mark detecting means (14, 15); and a work plate adjusting means (11, 12, 13) for adjusting the position of said work plate (7) in accordance with the output of said mark detecting means (14, 15).

3. A roller offset printing apparatus according to claim 2, further comprising:

a drum lifting means (31) for lifting the roller transfer drum (1) in such a manner that said roller transfer drum (1) is lowered so as to bring said roller transfer drum (1) in contact with one of said master plate (6) and said work plate (7) in a first time period conducting at least said 8 roller offset printing operation, and said roller transfer drum (1) is disengaged from at least one of said master plate (6) and said work plate (7) in a second time period other than said first time period.

4. A roller offset printing apparatus according to claim 1, further comprising:

a drum free rotation driving means (2, 30, 31, 54, 55) for rotating said roller transfer drum (1) in accordance with the output signal of said rotation angle detection means (32) when said drum (1) is located between a first position where said roller transfer drum (1) begins to disengage from the end of said master plate (6) and a second transfer start position where said second transfer operation relative to said work plate is started, wherein said roller transfer drum (1) is rotated by said drum free rotation driving means in such a manner that said roller transfer drum (1) is angularly set at a position where said second transfer operation is started.

5. A roller offset printing apparatus according to claim 3, further comprising:

a drum free rotation driving means (54, 55) for rotating said roller transfer drum (1) in accordance with the output signal of said rotation angle detection means (32) when said drum (1) is located between a first position where said roller transfer drum (1) begins to disengage from the end of said master plate (6) and a second transfer start position where said second transfer operation relative to said work plate is started, wherein said roller transfer drum (1) is rotated by said drum free rotation driving means in such a manner that said roller transfer drum (1) is angularly set at a position where said second transfer operation is started.

6. A roller offset printing apparatus including:

a base (3);

a linear stage (4) movably mounted on said base (3) forwardly and backwardly;

a stage driving means (5) for driving said linear stage (4);

a master plate (6) disposed on said linear stage (4), said master plate (6) having ink pits (21) formed in a surface of said master plate (6) for reserving ink (20);

a work plate (7) provided adjacent to said master plate (6) at a predetermined interval on said linear stage (4);

a roller transfer drum (1) rotatably supported relative to said base (3); and a roller transfer drum driving means (2, 30, 50, 51, 52, 53, 54, 55) for driving said roller transfer drum (1), wherein said roller offset printing apparatus comprising:

a rotation angle detection means (32) for detecting the rotation angle of said roller transfer drum (1); and a controlling means (24) for controlling said roller transfer drum driving means (2, 30, 50, 51, 52, 53, 54, 55) in accordance with an output of said rotation angle detection means (32) in such a manner that a first initial rotating angle of said drum (1) at which said drum (1) is brought in contact with the upstream edge of said master plate (6) is corresponding with a second initial rotating angle of said drum (2) at which said drum (1) is brought in contact with the upstream edge of said work plate (5), wherein said controlling means (24) controls said roller transfer drum driving means when said roller transfer drum (1) is positioned between said master plate (6) and said work plate (7).

7. A roller offset printing apparatus according to claim 6, further comprising:

a drum lifting means (31) for lifting the roller transfer drum (1) in which said roller transfer drum (1) is lowered so as to bring said roller transfer drum (1) in contact with one of said master plate (6) and said work plate (7) in a first time period conducting at least a roller offset printing operation, and said roller transfer drum (1) is disengaged from at least one of said master plate (6) and said work plate (7) in a second time period other than said first time period.

8. A roller offset printing apparatus according to claim 6, further comprising:

an alignment mark detecting means (14, 15) for detecting a position of said master plate (6) and said work plate (7); and a master plate adjusting means (8, 9, 10) for adjusting the position of said master plate (6) in accordance with the output of said mark detecting means (14, 15); and a work plate adjusting means (11, 12, 13) for adjusting the position of said work plate (7) in accordance with the output of said mark detecting means (14, 15).

9. A roller offset printing apparatus according to claim 6, in which said roller transfer drum driving means (2, 30, 50, 51, 52, 53, 54, 55) comprising:

first and second pinions (50*a*, 50*b*) provided at opposite ends of said roller transfer drum (1);

a first fixed rack (52) formed on one side of said linear stage (4) and engaged with said first pinion (50*a*), said first fixed rack (52) being long enough to move said roller transfer drum (1) from an end portion of said master plate (6) to the other end of said master plate (6) when the stage 4 is driven by said stage driving means (5);

a second fixed rack (53) formed on the one side of said linear stage (4) and engaged with said first pinion (50*a*), said second fixed rack (53) being long enough to move said roller transfer drum (1) from an end portion of said work plate (7) to the other end of said work plate (7) when the stage (4) is driven by said stage driving means (5);

a slide rack (54) located on the other side of said linear stage (4) and engaged with said second pinion (50*b*); and a driving means for slidably moving said slide rack (54) so as to rotate said drum (1) through said second pinion (50*b*) when said first pinion is disengaged from said first and second fixed rack.

* * * * *